United States Patent [19]

Yanai

[11] 3,930,785

[45] Jan. 6, 1976

[54] PORTABLE LIGHTER

[76] Inventor: Taro Yanai, No. 6-15, Ohtemachi 3-chome, Maebashi, Gunma, Japan

[22] Filed: Apr. 5, 1974

[21] Appl. No.: 458,067

[52] U.S. Cl. ..... 431/127
[51] Int. Cl.[2] ..... F23Q 2/32
[58] Field of Search ..... 431/127

[56] References Cited

UNITED STATES PATENTS

| | | | |
|---|---|---|---|
| 1,057,585 | 4/1913 | Schlick | 431/127 |
| 2,018,094 | 10/1935 | Smith | 431/127 |
| 2,140,277 | 12/1938 | Aronson | 431/127 |

FOREIGN PATENTS OR APPLICATIONS

| | | | |
|---|---|---|---|
| 507,004 | 6/1920 | France | 431/127 |

*Primary Examiner*—Carroll B. Dority, Jr.
*Attorney, Agent, or Firm*—Burgess, Ryan and Wayne

[57] ABSTRACT

An ignition rod combined with a casing is provided with a tip for ignition normally placed within the casing, the tip holding a striking piece which is firmly but detachably mounted on its end, the striking piece being firmly held by the tip for ignition at the time of striking but easily removed therefrom at the time of replacement.

7 Claims, 4 Drawing Figures

PORTABLE LIGHTER

The present invention relates to a portable lighter, and more particularly relates to an improvement of a portable lighter having an ignition surface and an ignition rod, which is strongly struck against a striking surface for ignition.

A portable lighter of the above-described type is usually provided with a striking piece and ignition wicks disposed on one end of the tip of its ignition rod. At the time of ignition, the ignition rod is taken out of a casing of the lighter and the striking piece of the ignition rod tip is strongly struck against a striking surface formed on one side face of the casing.

In order to withstand the big shock at the time of the striking for ignition, it is required that the striking piece should be secured on the ignition rod tip very firmly. In other words, accidental falling-off of the striking piece from the ignition rod tip must be very effectively prevented.

On the other hand, when the striking piece is accidentally broken during use and or when the ignition wicks are worn out after a long use, it is preferable that these members can be very easily removed from the ignition rod for replacement.

The object of the present invention is to provide a portable lighter which can satisfy the above-described requirements.

In accordance with the basic aspect of the present invention, a striking piece is received in slits formed diametrally transverse the tip end of the ignition rod and firmly held therein by a fixing sleeve screwed over the tip end. When necessary, the striking piece and the ignition wicks can be very easily removed from the tip end of the ignition rod by loosening the fixing sleeve screwed over the tip end.

Figure 1:
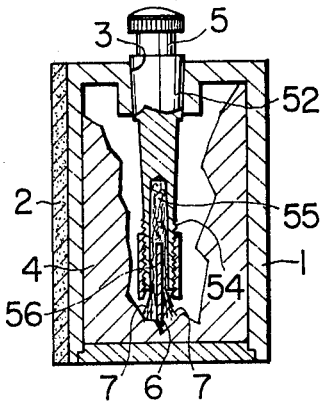
Figure 2:
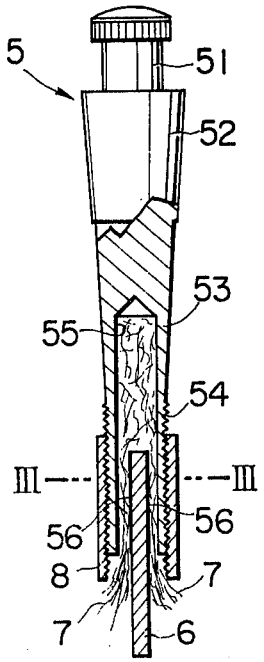
Figure 4:
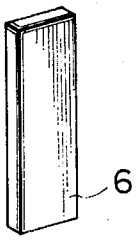
Figure 3:
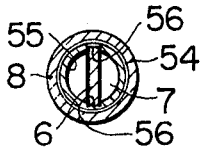

Further features and advantages of the present invention will be explained in more detail, reference being made to the accompanying drawings, in which;

FIG. 1 is a side view, partly in section, of an embodiment of the present invention, FIG. 2 is a side view, partly in section, of an embodiment of an ignition rod used for the portable lighter shown in FIG. 1, FIG. 3 is a cross sectional view taken along the line III—III in FIG. 2, and FIG. 4 is a perspective view of a striking piece used for the ignition rod shown in FIG. 2.

Now referring to FIG. 1, a hollow casing 1 is provided with a striking surface 2 disposed on one side surface thereof, a center hole 3 which converges towards the inner hollow of the casing 1 and fuel padding 4 impregnated with suitable fuel material.

An ignition rod 5 is inserted into the inner hollow of the casing 1 through the above-described center hole 3. This ignition rod 5 is provided with a head 51 which is suited for handling by fingers and is to be exposed out of the casing 1 when the ignition rod 5 is combined with the casing 1. The rod 5 also has a conical stem 52 which is suited for a snug engagement with the wall of center hole 3 and a cylindrical tip 53 which is suited for holding of a later described striking piece and formed axially integrally of the conical stem 52.

The structure of the ignition rod 5, especially its cylindrical tip 53, is shown in detail in FIGS. 2 and 3, in which the cylindrical tip 53 converges towards its open end and, in the portion near the open end, is provided with an outer thread 54. The cylindrical tip 53 is further provided with an axial center hole 55 which is open at one end thereof.

As is clearly shown in FIG. 3, slits 56 are formed diametrally through the peripheral wall of the cylindrical tip 53 and these slits 56 are suited for receiving snugly a striking piece 6 such as shown in FIG. 4. This striking piece 6 is made up of such a hard material as steel and is preferably a thin rectangular plate. Ignition wicks 7 are inserted into the center hole 55 of the cylindrical tip 53 with their ends being partly exposed outside the open end of the cylindrical tip 53. Loss of the ignition wicks 7 is prevented by clamping between the striking piece 6 and the peripheral wall of the cylindrical tip 53.

A fixing sleeve 8 provided with an inner thread is screwed over the outwardly threaded end position of the cylindrical tip 53 in order to firmly hold the striking piece 6 within the diametral slits 56. Because the striking piece 6 is very firmly held within the diametral slits 56 being fastened by the fixing sleeve 8 screwed over the end portion of the cylindrical tip 53, undesirable loss of the same from its associated ignition rod 5 at the time of strong striking for ignition can be effectively prevented.

On the other hand, by removing the fixing sleeve 8 from the end position of the cylindrical tip 53, both the ignition wicks 7 and the striking piece 6 can be very easily disassembled from the ignition rod 5. This assures very easy replacement of the broken striking pieces and worn-out ignition wicks. In addition, because of the simplicity of the shape of the striking piece such as shown in FIG. 4, the same can be manufactured very easily with reduced manufacturing cost.

What is claimed is:

1. In a portable lighter including a hollow casing enclosing fuel padding impregnated with a fuel, and having a hole extending into the fuel padding and a striking surface on one outer surface thereof, and an ignition rod assembly removably insertable in said hole, the ignition rod assembly including a rod-shaped holder having one end adapted to be inserted in said hole, and an ignition wick and a striker piece mounted on said one end of said holder, whereby the ignition rod assembly may be manually removed from said holder to enable engagement of the striking piece with the striking surface to effect ignition of the wick; the improvement wherein said one end of said holder is externally threaded and has a diametral slit extending thereacross and a hole extending axially therein, said striker piece being mounted in said slit and extending across said hole, said wick being positioned within said hole at the side of said striker piece, and further comprising a sleeve having internal threads engaging said threads of said holder for holding said striker piece in said slit.

2. The portable lighter of claim 1, wherein said end of said holder is cylindrical, and said hole extends coaxially therein.

3. The portable lighter of claim 1, wherein said striker piece comprises a thin rectangular plate.

4. The portable lighter of claim 3, wherein said striker piece is of steel.

5. The portable lighter of claim 3, wherein said holder has a conical stem for cylindrically engaging said hole of said casing.

6. The portable lighter of claim 1, wherein said end of said holder is cylindrical, the hole extending therein extending coaxially therein, said striker piece comprising a thin rectangular plate extending beyond said end of said holder and engaging said slit on both sides of the hole in said holder, said wick extending in said hole on both sides of said plate and beyond said end of said holder.

7. The portable lighter of claim 6, wherein said wick extends into said hole in said holder beyond the edge of said plate therein.

* * * * *